United States Patent [19]

Oatman

[11] Patent Number: 4,592,154

[45] Date of Patent: Jun. 3, 1986

[54] ATHLETIC SHOE

[76] Inventor: Donald S. Oatman, 6122 Patrick Henry, San Antonio, Tex. 78233

[21] Appl. No.: 746,569

[22] Filed: Jun. 19, 1985

[51] Int. Cl.[4] ..... A43B 11/00

[52] U.S. Cl. ..... 36/114; 36/50

[58] Field of Search ..... 36/114, 50, 47, 138, 36/45, 58.5

[56] References Cited

U.S. PATENT DOCUMENTS

| | | | |
|---|---|---|---|
| 669,417 | 3/1901 | Klett | 36/50 |
| 1,286,787 | 12/1918 | Rokahr | 36/114 |
| 1,678,241 | 7/1928 | Benz | 36/50 |
| 2,539,761 | 1/1951 | Whitman | 36/114 |
| 3,138,880 | 6/1964 | Kunzli | 36/114 |
| 3,327,410 | 6/1967 | Park et al. | 36/114 |
| 3,464,125 | 9/1969 | Conway | 36/114 |
| 3,555,706 | 1/1971 | Edmonds | 36/114 |
| 3,934,346 | 1/1976 | Sasaki et al. | 36/50 |
| 4,114,297 | 9/1978 | Famolare | 36/50 |
| 4,296,558 | 10/1981 | Antonious | 36/50 |
| 4,342,161 | 8/1982 | Schmohl | 36/50 |
| 4,361,970 | 12/1982 | Wren, Jr. et al. | 36/50 |
| 4,441,265 | 4/1984 | Burns et al. | 36/50 |
| 4,442,613 | 4/1984 | Dobbin | 36/50 |
| 4,476,639 | 10/1984 | Zaccaria | 36/114 |

*Primary Examiner*—Werner H. Schroeder
*Assistant Examiner*—Mary A. Ellis
*Attorney, Agent, or Firm*—Norvell & Associates

[57] ABSTRACT

An athletic shoe comprises a conventional rubber-like sole which is secured to a conventional fabric or leather upper defining a lengthwise extending slot overlying a tongue secured to the rear end of the toe portion of the upper. A plurality of pliant retaining bands are employed to effect the securement of the shoe to the foot of the user. Each retaining band passes beneath a flexible, resilient cushion insole and then upwardly along the inner wall of the upper and outwardly through one of a plurality of apertures provided along the edges of the slot which overlies the tongue of the shoe. The tightening of the pliant bands effects not only the pulling of the upper portion of the shoe into snug engagement with the top portions of the foot of the user but also elevates the cushion insole into snug engagement with the bottom portions of the foot of the user.

10 Claims, 6 Drawing Figures

ATHLETIC SHOE

BACKGROUND OF THE INVENTION

1. Field of the Invention

The invention relates to the construction of an athletic shoe and particularly to a unique configuration of pliant bands or laces utilized for securing the shoe to the foot of the user.

2. Summary of the Prior Art

Athletic shoes are produced in large quantities to satisfy the ever increasing demand for athletic and recreational activities by all ages of the population. Such activities include the more vigorous sports such as football, soccer, basketball, track, and tennis, but many people require improved foot comfort when engaging in the simple activity of walking or jogging.

In any of these activities wherein the bottom of the foot is subject to repeated impacts with the sole of the shoe, it is essential that the shoe be snugly and tightly secured to the foot at all times. To attack this problem, the prior art has resorted to multiple flaps overlying the slot normally provided in the upper of the shoe in overlying relation to the tongue of the shoe and a plurality of laces or other fastening devices have been employed to separately secure such flaps together. See for example U.S. Pat. Nos. 4,442,613, 1,539,762, 3,626,610, 3,934,346, 4,296,558, and 3,464,125. This method of fastening does effect a tight securement of the side wall portions of the upper to the foot but completely overlooks the fact that there are many portions of the bottom of the foot, particularly the area rearward of the toes which are normally spaced above the insole of the shoe. So long as such space exists, and considering the flexible nature of the average foot, there are portions of the foot that are spaced above the insole that are subjected to an impact each time that the shoe engages the ground. The minimization of the effects of such impacts on the foot by utilization of a novel configuration and location of shoe laces or pliant bands effecting the securement of the shoe and a cushion insole to the foot of the user is the primary distinction of this invention over the prior art.

SUMMARY OF THE INVENTION

This invention provides an athletic shoe construction incorporating a conventional sole, a toe portion secured to the front perimeter of the sole, an upper integral with or secured to the rear edge of the toe portion and perimetrically secured to the remaining rear portions of the sole. The upper defines a conventional lengthwise extending slot and a tongue, which is generally padded, is secured at its forward end to the rear end of the toe portion and underlies the slot in the upper. A plurality of apertures are provided in aligned pairs along the length of the slot in the upper, permitting shoelaces or pliant bands to be inserted therein.

In accordance with this invention, a resiliently flexible, cushioned insole is provided which is inserted within the assembled shoe in overlying comforming relationship to the sole of the shoe. The forward portions of such insole are not secured in any manner to the sole of the shoe, in fact, the entire insole may just lie on the sole of the shoe, being held in position by the surrounding walls of the toe portion and the upper.

The fastening of the shoe to the foot of the user is accomplished by a plurality of pliant bands which pass transversely beneath the insole and extend upwardly along the interior of the shoe so that the opposed ends of each band project outwardly through the aligned apertures provided along the edges of the slot which overlies the tongue. The ends of the bands are then drawn up tightly to pull the edges of the upper slot together to conform to the foot of the wearer and concurrently to raise the engaged portion of the cushioned insole into conforming relation to the bottom and adjacent side portions of the foot of the user.

The pliant bands may comprise any elongated flexible material such as a shoelace or, in another modification of the invention, may comprise a band of fabric having patches of hook and slot defining materials respectively secured to the ends of the band. In such case, the apertures along the edges of the slot in the upper are of course elongated to conveniently accommodate the width of the pliant bands.

In any modification of this invention, however, the bottom of the cushion insole is traversed by lengthwise spaced bands of pliant material which are then drawn by the fastening of such bands into snug conformity with the bottom of the foot, thus assuring that the insole always conforms to the bottom and immediately adjacent side portions of the foot of the user. With this construction, the user experiences an increased degree of comfort particularly during exercises that involve repeated impact contacts of the bottom of the foot with the sole of the shoe.

Further advantages of the invention will be readily apparent to those skilled in the art from the following detailed description, taken in conjunction with the annexed sheets of drawings, on which is shown two preferred embodiments of the invention.

DESCRIPTION OF THE PREFERRED EMBODIMENT

Figure 1:
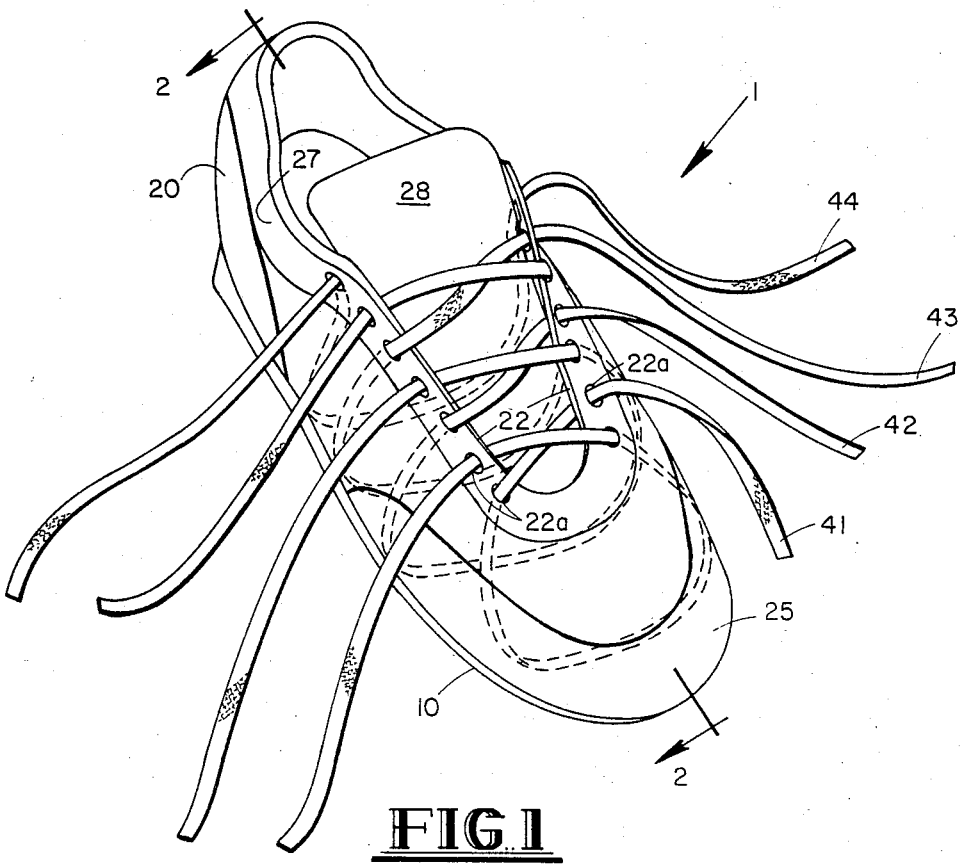
FIG. 1 is a perspective view of a complete athletic shoe embodying this invention and utilizing a plurality of shoelaces as the medium for effecting the securement of the shoe to the foot of the user.
Figure 2:
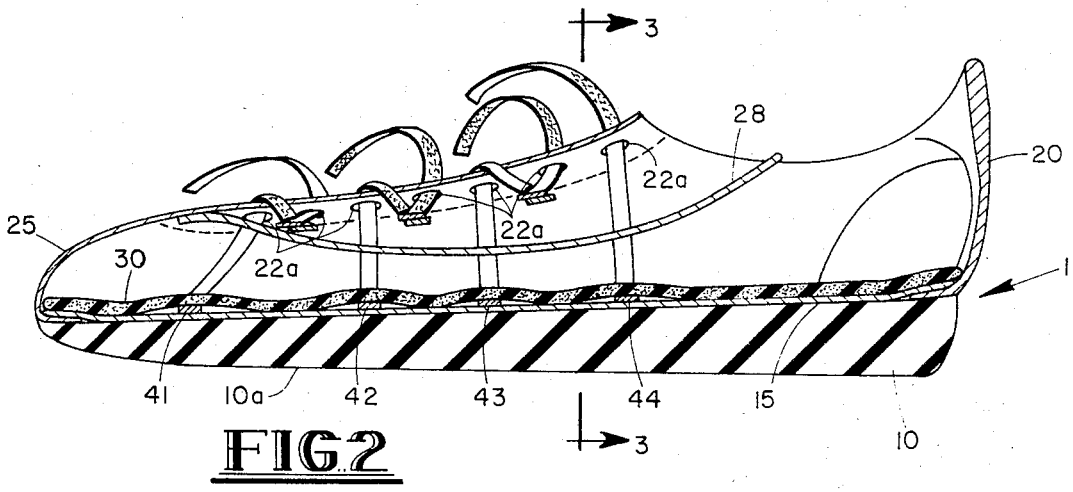
FIG. 2 is a sectional view taken on the plane 2—2 of FIG. 1.
Figure 3:
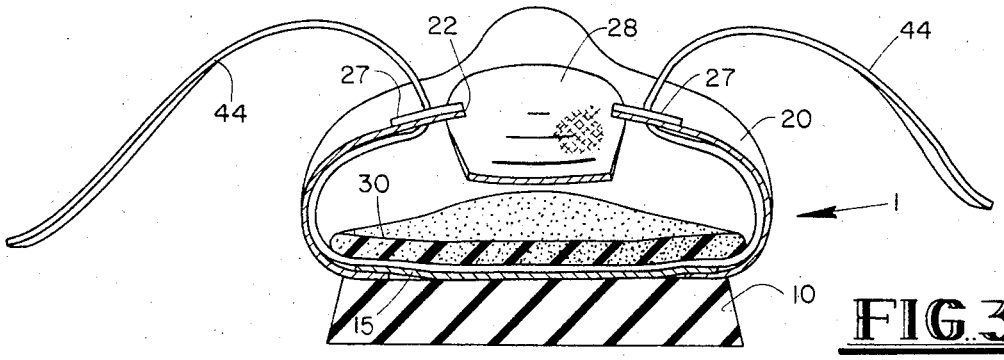
FIG. 3 is a sectional view taken on the plane 3—3 of FIG. 2.
Figure 4:
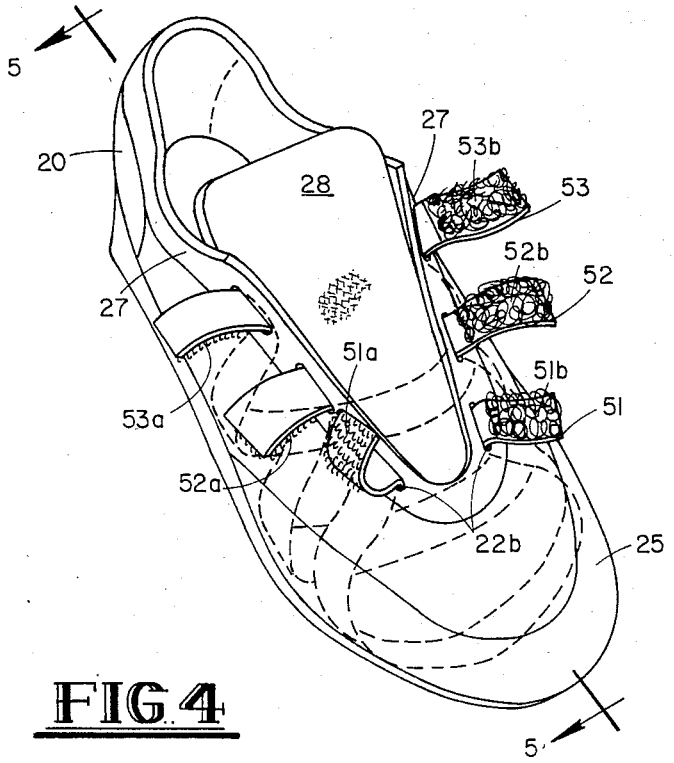
FIG. 4 is a perspective view of an athletic shoe embodying this invention wherein pliant bands of fabric material are employed as the shoe fastening medium.
Figure 5:
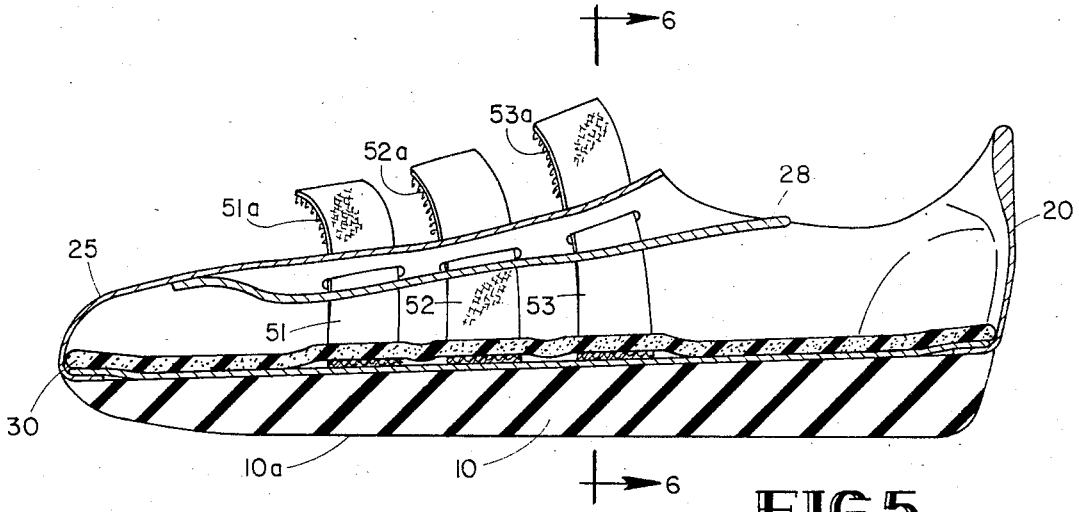
FIG. 5 is a sectional view taken on the plane 5—5 of FIG. 4.
Figure 6:
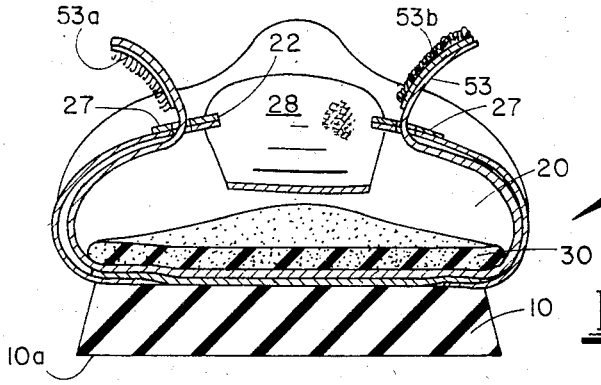
FIG. 6 is a sectional view taken on the plane 6—6 of FIG. 5.

Referring to FIGS. 1 through 3, an athletic shoe 1 embodying this invention comprises a conventional sole 10, the ground engaging portion 10*a* of which is preferably formed from a resilient material such as synthetic rubber or an elastomeric plastic material. An upper 20 is perimetrically secured to the sole 10 in conventional fashion. Upper 20 is formed from any relatively tough, pliant material such as canvas, leather, artificial leather or other materials commonly used for the upper portions of an athletic shoe. A primary insole 15 conforming exactly to the configuration of the sole 10 is inserted and adhesively secured to the top portions of the sole 10 and the bottom perimeter portions of the upper 20. If desired, a raised arch support (not shown) may be built into primary insole in conventional fashion.

Upper 20 may be formed with a toe portion 25 as an integral part of such upper, or such toe portion may be a separate element (not shown) which is then stitched or adhesively secured to the remaining portion of the upper. A tongue 28 is provided which is secured to the rear end of the toe portion 25 and projects rearwardly and upwardly to overlie the top portion of the foot of the user rearwardly of the toes.

The upper 20 is further provided with a lengthwise extending slot 22 extending from the rear of the toe portion 25 and overlying the tongue 28. The edges of the slot 22 may be reinforced by the addition of a reinforcing band 27 which is adhesively or otherwise suitably secured along the edges of the slot 22 and extends rearwardly along the top edges of the upper 20.

In accordance with this invention, a flexible resilient cushion insole 30 is inserted in the shoe 1 in overlying relationship to the primary insole 12. Insole 30 is formed of a material having the properties of a foam plastic or a soft rubber and provides a cushioned engagement between the bottom of the foot of the user and the primary insole 15. The cushion insole 30 may just be inserted within the upper 20 without any adhesive securement to the sole 10 or, if desired, the heel portions of the secondary insole 30 may be adhesively secured to the heel portions of the primary insole 15.

Along the edges of the notch 22, a plurality of laterally aligned holes or apertures **22*a* are provided in the upper to accommodate a plurality of sets of shoelaces, here shown as comprising four separate shoelaces 41, 42, 43 and 44. As is customary, each shoelace comprises an elongated band of pliant material and may be provided with a crimped metal end or ferrule (not shown) to facilitate threading the ends of the laces in the selected apertures 22*a*. Each lace is, however, passed transversely beneath the insole 30 in lengthwise spaced relationship thereto, as best shown in FIG. 2. For convenience in assembly, the medial portion of each lace 41, 42, 43 and 44 may be adhesively secured to the bottom surface of the flexible insole 30 and thus all laces may be inserted in the shoe when the insole 30 is inserted. The ends of each lace pass upwardly through one of the shoelace apertures 22*a*. In a preferred form, four such apertures are provided for each shoelace so that an X pattern of each shoelace may be achieved by passing the end of each lace outwardly through one aperture 22*a* and then across and under the notch edge 22 and outwardly through another aperture 22*a***.

After the wearer inserts his foot into the shoe, he pulls the ends of each shoelace securely and this action has a dual effect. It not only pulls together the spaced edges 22 of the notch **22*a* to bring the upper into snug conformity with the top portions of the foot, but it also raises the overlying portions of the cushion insole 30 into engagement with the bottom surface of the foot. Thus, the foot is snugly engaged both by the upper of the shoe and the cushion insole by the successive tightening and tying of the laces 41, 42, 43, and 44**.

Referring now to the modification of FIGS. 3. through 5, the primary difference is the utilization of pliant bands of material as the fastening means for the shoe in place of shoelaces. Otherwise, the construction of the shoe is identical to that heretofore described. The apertures **22*b* provided along the edge of the lengthwise slot 22 in upper 20 are formed as elongated slots so as to readily accommodate the increased width of the retaining bands. Due to the increased width of the retaining bands, only three of such bands 51, 52 and 53 are employed, but in each case, the medial portions of the bands 51, 52 and 53 pass beneath lengthwise spaced portions of the cushion insole 30 and thus, when the bands are tightened and secured together, the cushion insole 30** is moved upwardly into snug engagement with the bottom of the foot and the surrounding side portions of the foot of the user.

The bands 51, 52 and 53 are conveniently secured together by providing the opposed ends of such bands respectively with a patch of conventional hook defining material **51*a*, 52*a* and 53*a* and the other end of the band with a patch of loop defining material 51*b*, 52*b* and 53*b*. This form of fabric retention material is well known in the art and is sold under the trademark "VELCRO". The ends of the bands 51, 52 and 53 are brought upwardly around the inside of the upper 20 and passed outwardly through an aligned pair of elongated slots 22*b*. The tightening of the bands can then be effected to simultaneously bring the side walls of the notch 22 into snug engagement with the foot and concurrently move the cushion insole 30 upwardly into engagement with the bottom of the foot. The interengagement of the hook portions 51*a*, 52*a*, and 53*a*, respectively, with the loop portions 51*b*, 52*b*, and 53*b*** effect the snug securement of the bands together.

From the foregoing description, those skilled in the art will readily recognize that the shoe construction embodying this invention provides a substantially higher degree of snug engagement of the uppers 20 and the cushion insole 30 with the medial portions of the foot of the user, thus contributing to the comfort of the athletic shoe when subjected to repeated impacts with the ground.

What is claimed and desired to be secured by Letters Patent is:

1. An athletic shoe comprising in combination a sole and a flexible upper secured to the sole, said upper including a slot lengthwise aligned relative to the medial portion of said sole, said upper having a plurality of apertures spaced along each side of said slot; a flexible innersole mounted in said upper in overlying conforming relation to said sole with at least the forward portions thereof being unsecured to said sole; and a plurality of elongated pliant fastening bands, the central portions of said bands respectively passing transversely under said unsecured forward portions of said insole in lengthwise spaced relation; and the end portions of said bands passing outwardly through said apertures, whereby securing said end portions of each band together concurrently pulls together the opposed slot sides of the upper and pulls lengthwise spaced portions of the forward portions of said insole upwardly and inwardly into snug engagement with the bottom and adjacent side portions of an inserted foot.

2. The athletic shoe of claim 1 wherein each said pliant band comprises a shoelace, whereby the band ends are tied in a shoelace knot.

3. The athletic shoe of claim 1 wherein each said pliant band comprises end portions respectively formed of hook defining and loop defining fabric portions which are detachably engageable on contact, thereby permitting the securing of said band end portions together with any selected degree of tightness in each said pliant band.

4. The athletic shoe of claim 3 wherein each said pliant band comprises a fabric web; a patch of hook defining material secured to one side of one end of said fabric web; and a patch of loop defining material secured to the other side of the other end of said woven fabric web, whereby said hook and loop patches are juxtaposed to detachably secure said band end portions together with any selected degree of tightness in each said pliant band.

5. The athletic shoe of claim 1 wherein said bands are adhesively secured to the underside of said flexible insole.

6. A foot conforming athletic shoe comprising a sole; a toe enclosing portion secured to the front of said sole, an upper secured to the rear of said toe enclosing portion and to the remaining perimeter of said sole; a tongue projecting rearwardly from said toe enclosing portion; said upper defining a lengthwise slot having its edges overlying the edges of said tongue; a plurality of apertures spaced along the edges of said slot in transversely aligned relation; a flexible cushion insole inserted in said upper and conforming to said sole; at least the forward portions of said insole being unsecured to said insole; and a plurality of elongated flexible fastening bands, the central portions of said bands respectively passing transversely under said unsecured forward portions of said insole in lengthwise spaced relation; and the end portions passing outwardly through said apertures, whereby securing said end portions of each band together concurrently pulls together the opposed slot sides of the upper and pulls lengthwise spaced portions of the forward portions of said insole upwardly and inwardly into snug engagement with the bottom and adjacent side portions of an inserted foot.

7. The athletic shoe of claim 6 wherein each said band comprises a shoelace, whereby the band ends are tied in a shoelace knot.

8. The athletic shoe of claim 6 wherein each said band comprises end portions respectively formed of hook defining and loop defining fabric portions which are detachably engagable on contact, thereby securing said band end portions together with any selected degree of tightness in each said band.

9. The athletic shoe of claim 8 wherein each said band comprises a fabric web; a hook defining patch of material secured to one side of one end of said fabric web; and a loop defining patch of material secured to the other side of the other end of said fabric web, whereby said hook and loop patches are juxtaposed to detachably secure said band end portions together with any selected degree of tightness in each said band.

10. The athletic shoe of claim 6 wherein said bands are adhesively secured to the underside of said flexible in- sole.

* * * * *